US008753711B2

(12) United States Patent
Erlat et al.

(10) Patent No.: US 8,753,711 B2
(45) Date of Patent: Jun. 17, 2014

(54) EDGE SEALING METHOD USING BARRIER COATINGS

(75) Inventors: Ahmet Gun Erlat, Niskayuna, NY (US); George Theodore Dalakos, Niskayuna, NY (US); Brian Joseph Scherer, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 643 days.

(21) Appl. No.: 12/642,501

(22) Filed: Dec. 18, 2009

(65) Prior Publication Data

US 2011/0151200 A1 Jun. 23, 2011

(51) Int. Cl.
*B05D 5/12* (2006.01)

(52) U.S. Cl.
USPC ..... 427/96.2; 427/96.4; 427/96.6; 427/282

(58) Field of Classification Search
USPC ..... 427/96.2, 96.4, 96.6, 282; 313/506
See application file for complete search history.

(56) References Cited

U.S. PATENT DOCUMENTS

| | | | | |
|---|---|---|---|---|
| 5,681,666 | A * | 10/1997 | Treger et al. | 429/90 |
| 5,757,126 | A * | 5/1998 | Harvey et al. | 313/506 |
| 6,370,019 | B1 | 4/2002 | Matthies et al. | |
| 6,866,901 | B2 * | 3/2005 | Burrows et al. | 428/1.5 |
| 6,867,539 | B1 | 3/2005 | McCormick et al. | |
| 7,015,640 | B2 * | 3/2006 | Schaepkens et al. | 313/506 |
| 7,393,257 | B2 | 7/2008 | Spencer et al. | |
| 7,425,166 | B2 | 9/2008 | Burt et al. | |
| 2005/0224935 | A1 | 10/2005 | Schaepkens et al. | |
| 2005/0239294 | A1 | 10/2005 | Rosenblum et al. | |
| 2005/0249901 | A1 | 11/2005 | Yializis et al. | |
| 2006/0103301 | A1 | 5/2006 | Spencer et al. | |
| 2006/0159892 | A1 | 7/2006 | Mutsaers | |
| 2006/0283546 | A1 | 12/2006 | Tremel et al. | |
| 2006/0284556 | A1 | 12/2006 | Tremel et al. | |
| 2007/0281174 | A1 | 12/2007 | Moro et al. | |
| 2008/0006819 | A1 | 1/2008 | McCormick et al. | |
| 2008/0196664 | A1 | 8/2008 | David et al. | |

* cited by examiner

*Primary Examiner* — Brian K Talbot
(74) *Attorney, Agent, or Firm* — Jean K. Testa; Fletcher Yoder, P.C.

(57) ABSTRACT

The present techniques provide systems and methods for protecting electronic devices, such as organic light emitting devices (OLEDs) from adverse environmental effects. The edges of the devices may also be protected by a edge protection coating to reduce the adverse affects of a lateral ingress of adverse environmental conditions. In some embodiments, inorganic materials, or a combination of inorganic and organic materials, are deposited over the device to form a edge protection coating which extends approximately 3 millimeter or less beyond the edges of the device. In other embodiments, the device may be encapsulated with an organic region, and with an inorganic region, or the device may be encapsulated with inorganic materials, which may form the edge protection coating and may be combined with ultra high barrier technology. The coatings formed over the device may extend beyond the edges of the device to ensure lateral protection.

7 Claims, 4 Drawing Sheets

FIG. 4A
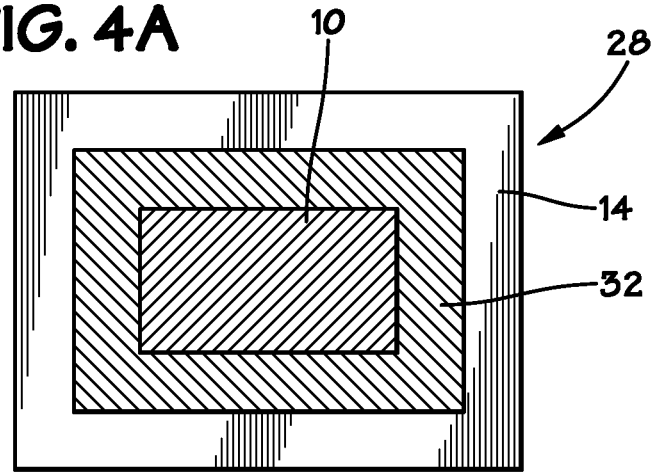
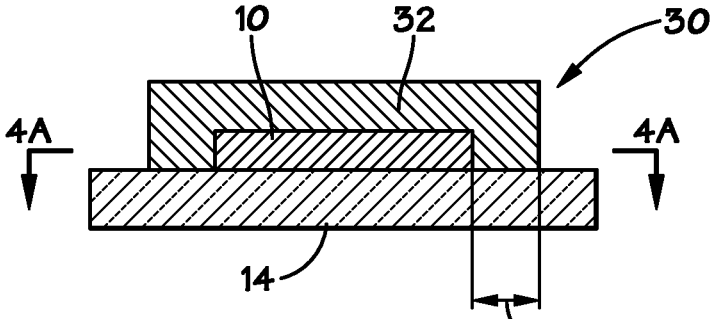
FIG. 4B
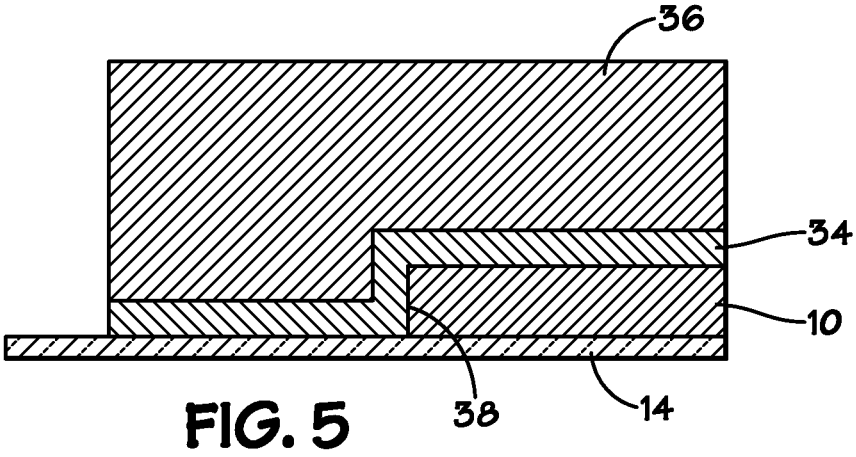
FIG. 5

FIG. 6
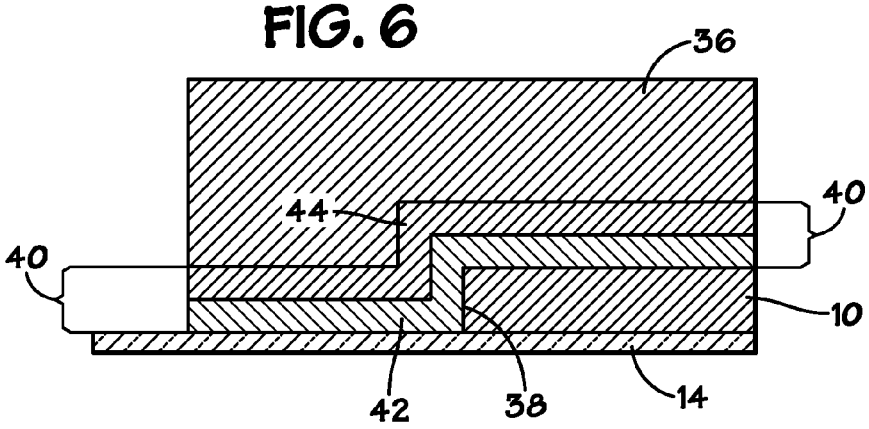
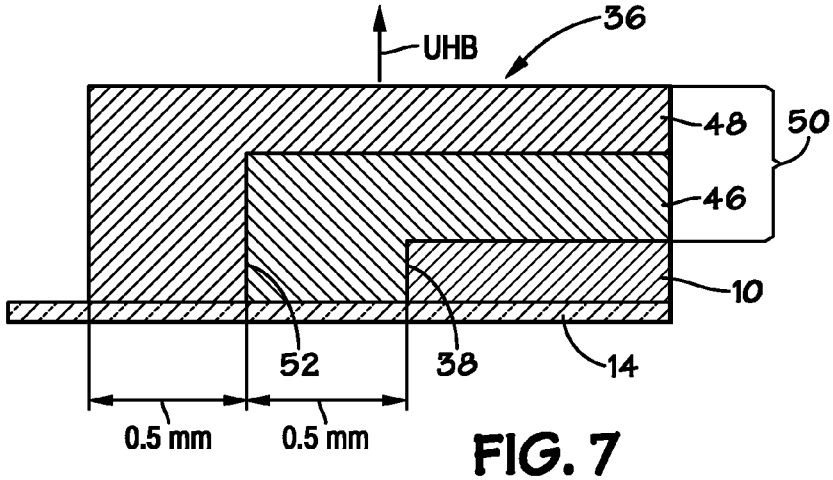
FIG. 7
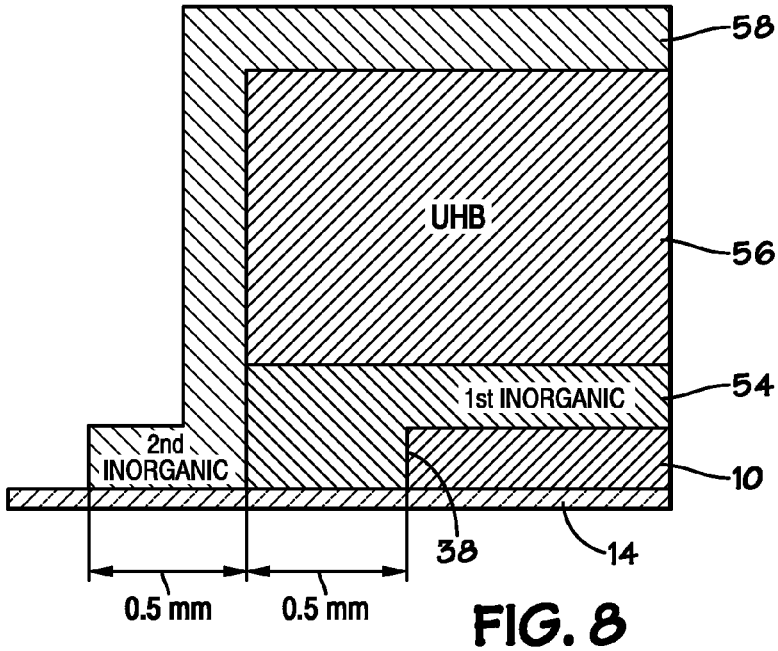
FIG. 8

EDGE SEALING METHOD USING BARRIER COATINGS

BACKGROUND

The present techniques relate generally to electronic devices. More specifically, the techniques relate to methods and systems for sealing structures in electronic devices.

Certain electronic devices have components that may be sensitive to adverse environmental conditions, including water vapor and oxygen. For example, display devices are commonly used as screens or displays for a wide variety of electronic devices, including televisions, portable and desktop computers, and handheld devices, such as cellular telephones, personal data assistants, and media players. The display components of such devices may display images by producing patterns of light in response to electrical signals. The patterns of light, or the images and graphics formed by the display device may be formed by individual light emitting structures, such as organic light emitting diodes (OLEDs). OLEDs may be optoelectronic devices having several layers of organic materials, and may include a pair of electrodes, and multiple layers of electroluminescent materials between the electrodes. For example, an OLED may typically include a substrate, an anode, a hole-transporting layer made of an organic compound, an organic luminescent layer with suitable dopants, an electron transport layer, and a cathode.

Light emitting structures, including OLEDs, may be prone to degradation under certain environmental conditions such as oxygen, moisture, chemicals, or other contaminants. For example, water vapor and oxygen ingress over time may cause degradation of light emitting polymers, undesired reactions at the electrode-organic layer interfaces, corrosion of metals, or undesired migration of ionic species, etc. Such degradation may result in the growth of dark spots, delamination, and/or the lateral shrinking of the emissive areas of the light emitting structure. Dark spots, delamination, and/or shrinking of the emissive areas of such structures may affect the quality and/or uniformity of the image displayed.

To minimize the degradation of electronic devices, such as light emitting structures, the structures may be hermetically sealed with thin film barrier coatings to protect against adverse environmental conditions. However, such coatings may provide only limited protection by substantially covering the top of the device. For example, for a bottom emission OLED, the top of the device would constitute at least complete coverage over the cathode area defining the active light emitting portion. While barrier coatings may protect the top of the structure, oxygen, moisture, or other contaminants may still diffuse laterally into the structures due to insufficient protection of the edges of the device by the same barrier coating. Such diffusion may corrode or degrade light emitting structures laterally, possibly decreasing the electroluminescent area of the structure over time.

BRIEF DESCRIPTION

Some embodiments of the present techniques include a method of forming an edge protection coating over an electronic device by depositing substantially inorganic materials using a masking technique, such that the edge protection coating coats an area over the electronic device and has an edge width between approximately 50 micrometers and approximately 3 millimeters. A barrier coating may also be formed over the edge protection coating using the same mask to seal the device.

Another embodiment involves an edge protection coating, which includes a region of substantially inorganic materials covering an electronic device and having an edge width between approximately 50 micrometers and approximately 3 millimeters and a thickness between approximately 20 nanometers and approximately 300 nanometers. The edge width is the length of the edge protection coating extending from the edge of the electronic device.

One embodiment includes a method of forming an edge protection coating by depositing substantially organic materials and substantially inorganic materials to form the edge protection coating, such that the substantially organic materials has an edge width between approximately 50 micrometers and approximately 3 millimeter from the electronic device, and the substantially inorganic materials has an edge width between approximately 50 micrometers and approximately 3 millimeter from the edge of the organic materials.

In another embodiment a method of encapsulating a device is provided, which includes depositing the edge protection coating comprising substantially organic materials over the device first to form an organic region having an edge width between approximately 50 micrometers and approximately 3 millimeter from the edge of the device, and depositing substantially inorganic materials over the organic region to form an inorganic region having an edge width between approximately 50 micrometers and approximately 3 millimeters from the edge of the organic region.

One embodiment includes an edge protection coating for an electronic device having an organic region coating the device and having an edge width between approximately 50 micrometers and approximately 1 millimeter from the edge of the electronic device and an inorganic region coating the organic region and having an edge width between approximately 50 micrometers and approximately 1 millimeter from the edge of the organic region.

Yet another embodiment involves a method of encapsulating a device, including depositing substantially inorganic materials over a device to form an initial inorganic region having an edge width between approximately 50 micrometers and approximately 3 millimeter from the device edge and forming an ultra high barrier (UHB) coating over the initial inorganic region. A final inorganic coating may then be formed over the initial inorganic region and the barrier coating (UHB). The final inorganic coating may have an edge width between approximately 50 micrometers and approximately 3 millimeter beyond the edge of the initial inorganic region to encapsulate both the initial inorganic region and the barrier coating (UHB).

DRAWINGS

These and other features, aspects, and advantages of the present invention will become better understood when the following detailed description is read with reference to the accompanying drawings in which like characters represent like parts throughout the drawings, wherein:

FIG. 4 illustrates a top and side view of an edge protection coating and a barrier coating over a light emitting structure, in accordance with embodiments of the present techniques;

FIG. 5 depicts an edge protection coating and a barrier coating disposed over a light emitting structure to provide edge protection, in accordance with embodiments of the present techniques;

FIG. 6 depicts an edge protection coating and a barrier coating having inorganic and organic materials, disposed over a light emitting structure to provide edge protection, in accordance with embodiments of the present techniques;

FIG. 7 depicts a light emitting structure encapsulated with edge protection coating and a barrier coating in accordance with embodiments of the present techniques;

FIG. 8 depicts a light emitting structure and an ultra high barrier (UHB) coating encapsulated with an edge protection coating, in accordance with embodiments of the present techniques.

DETAILED DESCRIPTION

One or more embodiments of the present techniques will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for one of ordinary skill having the benefit of this disclosure.

The present techniques generally relate to protecting a structure in an electronic device against adverse environmental conditions. For example, the present techniques may apply to devices such as display devices, electrochromic devices, liquid crystal displays, organic light emitting diodes, light emitting diodes, photovoltaic devices, radiation detectors, sensors, integrated circuits, component(s) of medical diagnostic systems, or any combinations thereof. For instance, a device using a display, such as a cellular phone, desktop computer, area lighting application, signage, etc. may include an array of light emitting structures, such as organic light emitting diodes (OLEDs), light emitting diodes (LEDs), etc. Elements in such devices may be sensitive to environmental conditions.

As previously discussed, light emitting structures such as OLEDs may be prone to degradation under certain environmental conditions such as oxygen, moisture, chemicals, or other contaminants, which may cause reaction with the organic materials within each OLED structure, undesired reactions at the electrode-organic layer interfaces, corrosion of metals, or undesired migration of ionic species, etc. Degradation may result in the growth of dark spots, or lateral the shrinking of the emissive areas of the OLED structure. In display devices having multiple OLED structures (e.g., an array of OLEDs illuminating the display area), degradation of the OLED structures may affect the image displayed by the device. For example, dark spots or shrinking of the emissive areas of OLED structures may affect the quality and/or uniformity of the image displayed.

Figure 1:
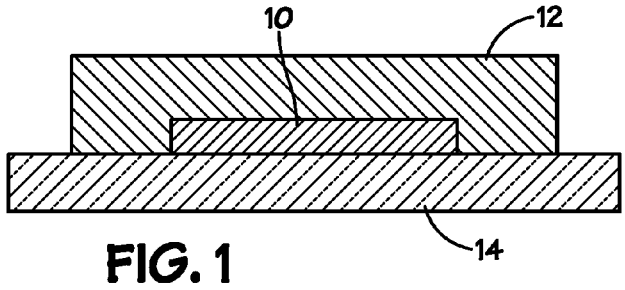
FIG. 1 illustrates a barrier film disposed over a light emitting structure on a substrate.
Figure 2:
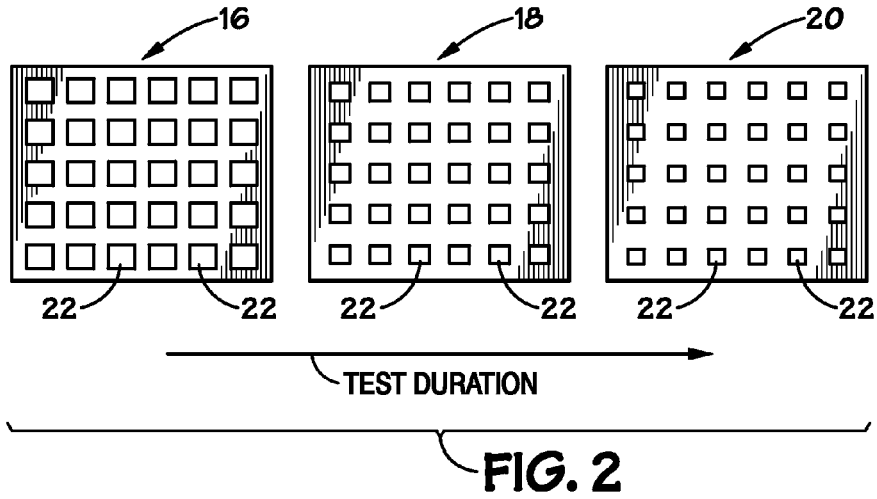
FIG. 2 is a top view illustration depicting pixel shrinkage due to degradation of a light emitting structure in a lateral direction.

To minimize the degradation of electronic devices or structures, such as OLEDs, the structures may be hermetically sealed with thin film coatings comprising barrier materials to protect against adverse environmental conditions. As illustrated in FIG. 1, a device 10 on a substrate 14 may be protected (e.g., sealed, coated, layered) with various inorganic and organic materials, which make up the barrier film 12. Depending on the materials and the configuration of the barrier film 12, the sides of the device 10 in the substantially lateral plane may or may not be protected from environmental conditions. For example, some barriers may protect a top portion of the structure, but the sides of the structure may still be susceptible to substantial ingress of oxygen, moisture, or other contaminants in the lateral direction. The lateral ingress of oxygen, moisture, or other contaminants may cause degradation of the active part of an electronic device. For example, an OLED structure may suffer substantial pixel shrinkage due to degradation from the sides of the structure. The series of illustrations 16, 18, and 20 in FIG. 2, which have identical dimensions, depicts pixel shrinkage through an environmental testing (at a specific temperature and humidity) duration. From an initial condition displayed in photograph 16, the pixels 22 may be visibly smaller after some length of exposure to lateral moisture ingress, as displayed in photographs 18 and 20.

Figure 3:
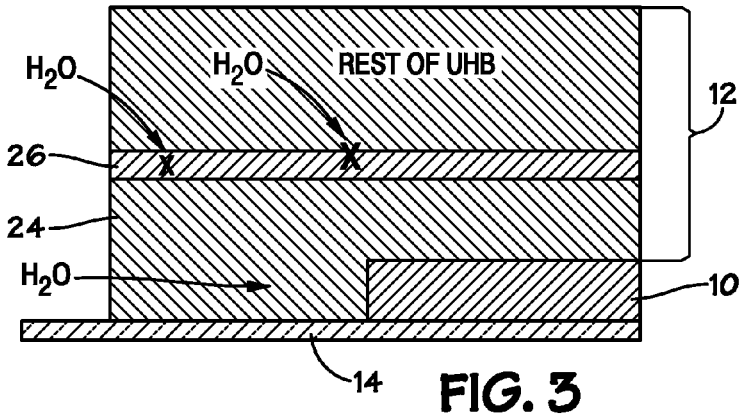
FIG. 3 (PRIOR ART)
FIG. 3 illustrates a typical seal over a light emitting structure and possible directions of lateral ingress of environmental conditions.

The illustration of an encapsulated device 10 on a substrate 14 in FIG. 3 further illustrates possible paths of ingress by water vapor, as represented by the arrows. While a barrier may include layers of organic and/or substantially permeable materials 24 and inorganic materials 26, the arrangement of such materials forming the barrier 12 may affect the permeability of water, oxygen, or other contaminants in certain directions through the barrier 12. For example organic materials 24 may be more permeable than inorganic materials 26, and water vapor may permeate through organic materials 24 laterally to the device 10. Inorganic materials may substantially block the permeation of water vapor, indicated by the X mark. However, inorganic materials may still contain defects, which may become pathways through which water vapor may permeate to the device 10. Thus, the configuration of materials may be important in forming a barrier that sufficiently protects a device 10, including protecting the edge or the sides of the device 10, from adverse environmental conditions.

Embodiments of the present techniques may include forming an "edge protection coating" that may protect the lateral portions of the device. An edge protection coating may include structures such as one or more films, coatings, layers, regions, or any other structure of materials suitable for protecting a structure, especially the lateral portions of the structure, from adverse environmental conditions. For example, while some methods of protecting a structure may include protecting a structure vertically (e.g., the top surface), an edge protection coating of the present techniques may also protect a structure laterally (e.g., the edge(s)). A edge protection coating may include "edge protection," "edge sealing," or "edge coating," which may refer to a protection from adverse environmental conditions in the lateral direction, or a reduction in leakage of environmental agents (e.g., water vapor, chemicals, oxygen, etc.) in the lateral direction. In some embodiments, the edge protection coating may be combined with a barrier coating, which substantially protects the top portions of the device to further the seal the device.

Materials for edge protection coating and barrier coating may include organic materials, inorganic materials, and/or ceramic materials and combinations thereof. For example, organic materials may comprise carbon, hydrogen, oxygen, and optionally other minor elements, such as sulfur, nitrogen, silicon, etc., depending on the types of reactants. Inorganic and ceramic coating materials typically comprise oxide, nitride, carbide, boride, or combinations thereof of elements of Groups IIA, IIIA, IVA, VA, VIA, VIIA, IB, and IIB, metals of groups IIIB, IVB, and VB, and rare-earth metals. Further examples of materials and combinations, and other details of one type of graded composition barrier, are disclosed in U.S. Pat. No. 7,015,640, herein incorporated by reference. Materials that form the coatings may be deposited via a plasma-enhanced chemical vapor deposition (PECVD) technique, or any other technique suitable for forming a barrier over an electronic device in accordance with the present techniques. Suitable deposition modes for PECVD may include, for example, plasma enhanced (PE) mode deposition and/or reactive ion etch (RIE) mode deposition.

Furthermore, a "device" that may be protected by the barrier may refer to any electronic device, including display devices, electrochromic devices, liquid crystal displays, organic light emitting diodes, light emitting diodes, photovoltaic devices, radiation detectors, sensors, integrated circuits, component(s) of medical diagnostic systems, etc, or any devices which may be sensitive to environmental conditions. An OLED may be used in this application as one example of an electronic device, which may be protected by a barrier.

FIG. 4 illustrates a top view 28 and a side view 30 of a device 10 on a substrate 14 that is protected by an edge protection coating 32, in accordance with one embodiment of the present techniques. As depicted, the edge protection coating 32 may substantially cover a top portion of the device 10, and may extend from the top of the device 10 over the side of the device 10 to cover the edge of the device 10. In some embodiments, the width of the edge, or the length of the edge protection coating 32 which extends beyond the top area of the device 10 (labeled "edge width" in the figures) may be less than approximately 3 mm wide, and in some embodiments, the edge seal may be less than approximately 1 mm wide. The edge protection coating may be suitable for protecting the active area of the device 10, including the lateral edges of the device 10, from adverse environmental conditions. As used herein the "active area" may refer to an area of the device 10 which may be affected by the lateral ingress of adverse environmental agents. For example, the active area of an OLED device may refer to any components of the device involved in emitting light (e.g., the cathode, the anode, layers of conductive and/or organic materials, etc.). "Covering" or "protecting" or forming a barrier over the device 10 may refer to covering, protecting, or forming a barrier substantially over the active area of the device 10. Furthermore, some components involved in emitting light may not be completely covered (e.g., the cathode and/or the anode may extend beyond the general active area to connect to other devices, the substrate, etc).

Various performance criteria may be used to determine the suitability of an edge protection coating (which may be used in conjunction with a barrier coating) for protecting structures, in accordance with the present techniques. For example, in some embodiments, a suitable edge protection coating may allow substantially zero edge leakage (no degradation of active area of device) for 500 hours or more in an environment having a temperature of 60° C. and a relative humidity (RH) of 90%. In other embodiments, a edge protection coating may allow substantially zero edge leakage at the same conditions (60° C. and 90% RH) for longer than 1000 hours, or may allow substantially zero edge leakage for different environmental conditions (85° C. and 85% RH) for approximately 500 hours or more. In some embodiments, edge protection coatings may reduce leakage, for example, reducing leakage to less than approximately 0.2 μm/hour for 500 hours or more at 60° C. and 90% RH, or reducing leakage to less than approximately 0.002 μm/hour for 500 hours or more at 60° C. and 90% RH. In each of the examples of reducing leakage, the corrosion rate would be less than approximately 1% lateral corrosion on each side of a rectangular calcium chip having areas of 10 mm×10 mm, and 100 μm×100 μm, respectively, and over 500 hours. While a calcium chip was used to determine the leakage rates in the examples above, the reduced leakage (e.g., no leakage for some amount of time in certain conditions, or less than 1% of the lateral side leakage for some amount of time in certain conditions) may also be used as performance criteria in evaluating the edge-protection capabilities of other electronic devices (e.g., device 10), in accordance with the present techniques. In other words, leakage reduction rates described may be similar to general performance criteria in evaluating the edge-protection for other devices, with appropriate modifications depending on the size, shape, and materials of the devices.

One embodiment for protecting a device (such as an OLED device), including the edges of the device, is illustrated in FIG. 5, which depicts an edge protection coating 34 disposed over a device 10. FIG. 5 (as well as FIGS. 3, 6-8, which will be discussed) illustrates only half of a cross section of a device 10, and depicts only one edge, such that different coatings may be more clearly labeled. However, embodiments of the present techniques may include coatings disposed over substantially an entire device 10. A barrier coating (e.g. UHB coating) 36 may be coated over the edge protection coating 34 in this embodiment.

The edge protection coating 34 may include inorganic materials, such as silicon nitride, for example. The inorganic materials in the edge protection coating 34 may be substantially impermeable to environmental conditions such as oxygen and water vapor in the lateral direction. These materials may also be thick enough to cover an edge 38 step of a device. For example, the edge protection coating may be approximately 20 nm to 200 nm in thickness, or thick enough such that the inorganic materials may cover an edge 38 of the device 10. As used herein, the "thickness" of the edge protection coating may refer to a vertical thickness of the coating (e.g., the height of the edge protection coating above the top surface of a device).

Furthermore, the edge protection coating 34 may be formed over the device 10 to extend the edges of the device 10 to ensure edge coverage. In one embodiment, the edge protection coating 34 may cover the device 10, and may extend approximately 1 mm or less around the edges of the device 10. In some embodiments, the edge protection coating 34 may be even wider in area, and may extend approximately 3 mm around the edges of the device. As used herein, the "edge width" or "width" of the edge of the edge protection coating may refer to a horizontal (i.e., lateral) dimension of the coating (e.g., the length of the coating which extends from an edge of the device 10). An edge protection coating having a sufficient edge width may be suitable for substantially protecting the device 10 from the lateral infusion of adverse environmental agents. Different methods, such as masking techniques, may be used to produce the edge protection coating 34 to suitable dimensions over the device 10, as will be further discussed with respect to FIG. 9.

As previously discussed, one method of protecting an electronic device 10, such as an OLED, may be to form a typical graded barrier, such as an ultra high barrier (UHB), which may be a more cost effective alternative to sealing with glass or metals caps using epoxy and desiccants. Further examples and details of the UHB are disclosed in U.S. Pat. No. 7,015,640, previously mentioned, and herein incorporated by reference. The present techniques may also incorporate edge protection techniques (e.g., edge protection coating 34) with graded barrier protection techniques, such as by using UHB techniques. For example, in some embodiments, a UHB 36 or any other type of thin film barrier coating may be formed over the edge protection coating 34.

Thus, in addition to protection in the vertical direction, as provided by at least the UHB 36, the present techniques also provide the edge protection coating 34 to protect the device 10 in the lateral direction. For example, in measuring the edge protection of a calcium chip, the embodiment depicted in FIG. 5 prevented substantially any lateral corrosion at 60° C. and 90% RH for more than 521 hours.

Another embodiment for protecting the edges of an electronic device is illustrated in FIG. 6. In this embodiment, an edge protection coating 40 may include organic and inorganic materials (for example, SiOC and SiN, respectively). The distribution of organic materials 42 and inorganic materials 44 may vary in different embodiments. For example, as depicted in FIG. 6, organic materials 42 may be deposited over the device 10, and inorganic materials 44 may be deposited over the organic materials 42. In other embodiments, different sequences of depositions of organic or inorganic materials, or multiple depositions of organic and/or inorganic materials, may form the edge protection coating 40.

In one embodiment, the organic portion 42 of the edge protection coating 40 may be approximately 50 nm or less in thickness, and in some embodiments, the organic portion 42 may be approximately 30 nm and deposited using RIE mode of PECVD. Further, in an embodiment, the inorganic portion 44 of the edge protection coating 40 may be approximately 30 nm to 200 nm in thickness. The organic portion 42 and the inorganic portions 44 of the edge protection coating 40 may extend beyond the device 10, to ensure coverage of an edge 38 of the device 10. For example, in some embodiments, the edge protection coating may cover the device 10 and extend approximately 1 mm or less. In some embodiments, it may extend 3 mm or less from the edges of the device 10. In one embodiment, a UHB 36 may be formed over the edge protection coating 40 to substantially protect the device 10 in the vertical direction from adverse environmental conditions. In one test for measuring the edge protection of a calcium chip using the embodiment depicted in FIG. 6, there was no substantial lateral corrosion detected in an environment set to 60° C. and 90% RH for more than 501 hours.

In some embodiments as shown in FIG. 7, a device 10 may be encapsulated by a edge protection coating 50 which includes an organic region 46 that encapsulates the device 10, and an inorganic region 48 that encapsulates the organic region 46. In one embodiment, organic materials may be deposited to form an organic region 46 having an edge width that that extends approximately 0.5 mm from an edge 38 of the device 10 to ensure encapsulation of the device 10, including coverage of the edge 38 of the device 10. The vertical thickness of the organic region 46 above the device 10 (in the z-direction) may be approximately 50 nm or less. Inorganic materials may be deposited to form an inorganic region 48 over the organic region 46 having an edge width approximately 0.5 mm from an edge 52 of the organic region 46 to encapsulate the organic region 46 which is encapsulating the device 10, and may extend sufficiently beyond the edge of the organic region 46 to cover the edge 52 of the organic region 46. The vertical thickness of the inorganic region 48 over the organic region 46 may be approximately 20 nm to 200 nm. In some embodiments, the edge protection coating 50 may be produced by using one or more masks to encapsulate the device 10 with organic and inorganic materials. For example, a mask having a window dimension approximately 0.5 mm outside the edges of the device 10 may be used to encapsulate the device 10 with the organic region 46, and a mask having a window dimension approximately 0.5 mm outside the edges of the organic region 46 may be used to encapsulate the organic region 46 (which encapsulates the device 10) with the inorganic region 48. In some embodiments, a UHB 36 may also be formed over the edge protection coating 50.

FIG. 8 illustrates another embodiment of forming an edge protection coating, which comprises coating 58 and coating 54 to protect the edges of a device 10. The device 10 may first be encapsulated with an initial inorganic region 54 having an edge width that is approximately 0.5 mm beyond the edge 38 of the device 10, such that the inorganic region 54 covers the edges of the device 10. In one embodiment, a UHB 56 may then be formed over the initial inorganic region 54. Further, a final inorganic coating 58 may be formed over the UHB 56, and over the initial inorganic region 54. The final inorganic coating 58 may have an edge width that is approximately 0.5 mm beyond an edge of the initial inorganic region 54 and/or the UHB 56. Thus, the adverse affects of any defects near the side regions of the initial inorganic region 54 may be reduced by the final inorganic coating 58, and/or adverse affects due to defects near the side regions of the final inorganic coating 58 may be reduced by the initial inorganic region 54. For example, in one test for measuring the edge protection of a calcium chip using the embodiment depicted in FIG. 8, there was no substantial lateral corrosion detected in an environment set to 85° C. and 85% RH for more than 595 hours.

In some embodiments, the combination of the initial inorganic region 54, the UHB 56, and the final inorganic barrier 58 may be formed using one or more masks. For example, a mask that extends approximately 0.5 mm beyond the device 10 may be used to deposit inorganic materials over the device 10, forming the initial inorganic region 54. The same mask may be used to form the UHB 56 over the initial inorganic region 54. Further, a mask extending approximately 0.5 mm beyond the edges of the initial inorganic region 54 may be used to form the final inorganic barrier 58.

Figure 9:
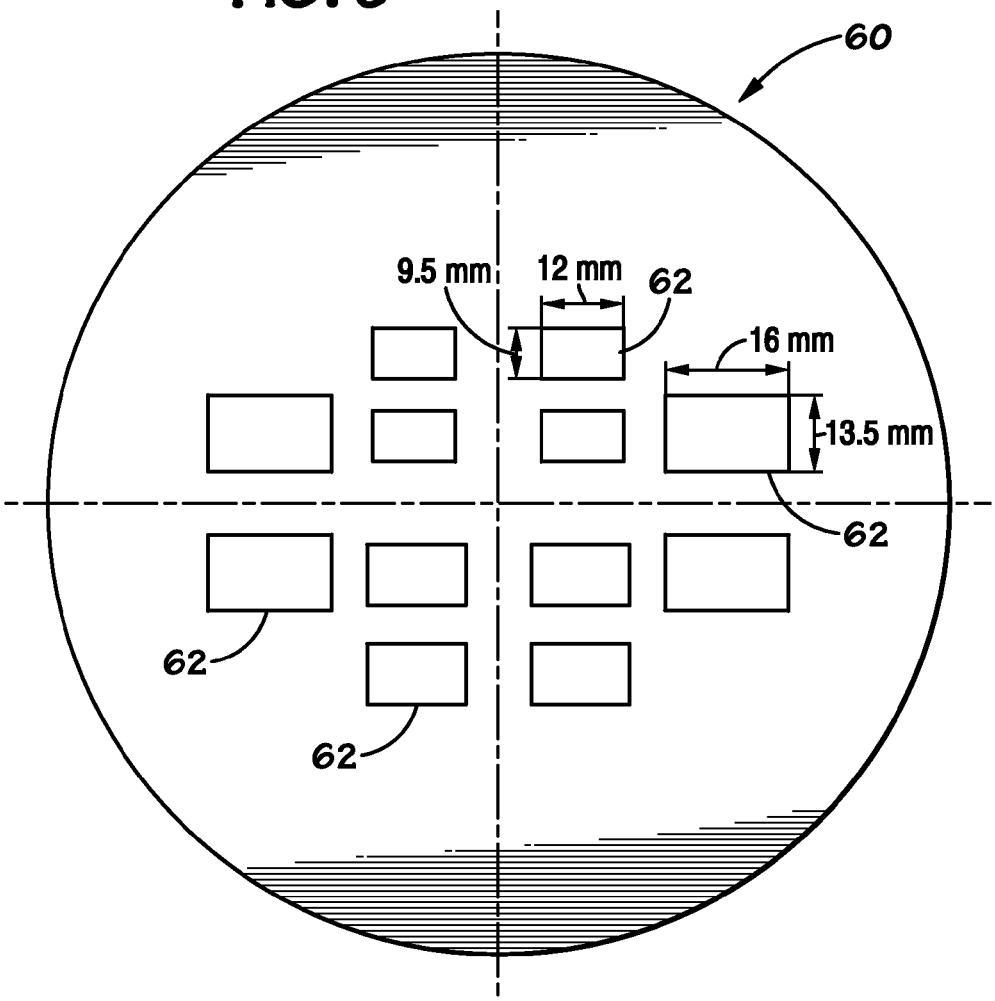
FIG. 9 depicts a top view of a mask used for sealing a light emitting structure, in accordance with embodiments of the present techniques.

One example of a mask 60 which may be used in forming any of the barriers or encapsulations in FIGS. 5-8 is illustrated in FIG. 9. As illustrated in this top view depiction of the mask 60, different sized windows 62 may be holes in the mask, shaped and sized such that materials may be deposited through the windows to form edge protection coatings and barriers over the devices 10 (as in FIGS. 1 and 3-8). As discussed, the windows 62 may be sized to extend a certain length beyond an edge of a device 10. For example, a window 62 that is 16 mm by 13.5 mm may extend 1 mm beyond each side of a structure that is 14 mm by 11.5 mm, or 3 mm beyond each side of a structure that is 10 mm by 7.5 mm.

Furthermore, each of the windows 62 in a mask 60 may be sized or shaped differently, depending on the dimensions of the devices 10 over which a coating is to be formed, or depending on the type of coating to be formed over a device 10. For example, in the embodiments described in FIGS. 7 and 8, an initial region (e.g., the organic region 46 of FIG. 7 or the initial inorganic region 54 of FIG. 8) may first be formed using a mask 60 having windows 62 that extend approximately 0.5 mm beyond the edges of the device 10. To further encapsulate the initial region encapsulating the device 10, a different window 62 and/or a different mask 60 may be used for depositing an additional coating (e.g., the inorganic region 48 of FIG. 7 or the final inorganic coating 58 of FIG. 8), which may be larger than the initial region to fully encapsulate the initial region. In one embodiment, a polyimide mask, or any mask suitable for forming a coating in accordance with the present techniques may be used.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of forming an edge protection coating over an electronic device, the method comprising:

depositing substantially organic materials, such that an organic region having an edge width between approximately 50 micrometers and approximately 3 millimeters is formed over the electronic device; and depositing substantially inorganic materials, such that an inorganic region having an edge width between approximately 50 micrometers and approximately 3 millimeters is formed over the electronic device or over the organic region, wherein the edge protection coating comprises the substantially organic materials and the substantially inorganic materials.

2. The method of claim 1, wherein depositing the substantially inorganic materials between approximately 50 micrometers and approximately 1 millimeter beyond the edge of the electronic device comprises depositing the substantially inorganic materials between approximately 50 micrometers and approximately 1 millimeter beyond the edge of the organic region.

3. The method of claim 1, the edge protection coating substantially prevents permeation of one or more of water vapor, oxygen, and chemicals to the electronic device in at least the lateral direction.

4. The method of claim 1, wherein the organic region is approximately 50 nanometers or less in thickness.

5. A method of encapsulating a device, the method comprising:

depositing substantially organic materials over the device to form an organic region having an edge width between approximately 50 micrometers and approximately 1 millimeter from an edge of the device; and depositing substantially inorganic materials over the organic region to form an inorganic region having an inorganic edge width between approximately 50 micrometers and approximately 1 millimeter from an edge of the organic region, wherein the organic region and the inorganic region form a edge protection coating encapsulating the device.

6. The method of claim 5, comprising forming an ultra high barrier (UHB) over the edge protection coating, wherein the UHB comprises one or more regions of organic and inorganic materials.

7. The method of claim 5, comprising using one or more masks to deposit the substantially organic materials and deposit the substantially inorganic materials.

* * * * *